US007933528B2

(12) United States Patent
Yoshioka et al.

(10) Patent No.: US 7,933,528 B2
(45) Date of Patent: Apr. 26, 2011

(54) IMAGE FORMING APPARATUS AND IMAGE FORMING METHOD FOR CORRECTING DENSITY NONUNIFORMITY

(75) Inventors: Tomoaki Yoshioka, Kanagawa (JP); Nobuo Hyakutake, Kanagawa (JP); Taku Fukuhara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 381 days.

(21) Appl. No.: 12/052,449

(22) Filed: Mar. 20, 2008

(65) Prior Publication Data

US 2009/0041486 A1 Feb. 12, 2009

(30) Foreign Application Priority Data

Aug. 6, 2007 (JP) ..... 2007-204117

(51) Int. Cl.
*G03G 15/00* (2006.01)

(52) U.S. Cl. ..... 399/49; 399/51

(58) Field of Classification Search ..... 399/49, 399/299, 302, 308, 53, 298, 46, 51
See application file for complete search history.

(56) References Cited

U.S. PATENT DOCUMENTS

| | | | | |
|---|---|---|---|---|
| 7,016,621 | B1 * | 3/2006 | Ng | 399/53 |
| 7,567,775 | B2 * | 7/2009 | Fukuhara | 399/302 |
| 2002/0085860 | A1 * | 7/2002 | Itaya | 399/237 |
| 2008/0152397 | A1 * | 6/2008 | Bae | 399/298 |

FOREIGN PATENT DOCUMENTS

| | | | |
|---|---|---|---|
| CN | 101008809 | | 8/2007 |
| JP | 1-134485 | | 5/1989 |
| JP | 07234617 | A * | 9/1995 |
| JP | 2001-066835 | | 3/2001 |
| JP | 2003-162125 | | 6/2003 |
| JP | 2004-138609 | | 5/2004 |
| JP | 2006-163267 | | 6/2006 |
| JP | 2006251717 | A * | 9/2006 |
| JP | 2006267519 | A * | 10/2006 |

OTHER PUBLICATIONS

Translation of JP2003-162125A; Jun. 6, 2003.*

* cited by examiner

*Primary Examiner* — Quana M Grainger

(74) *Attorney, Agent, or Firm* — Morgan, Lewis & Bockius LLP

(57) ABSTRACT

An image forming apparatus comprises a first image forming unit that transfers a base toner image formed on a first image carrier to an intermediate transfer member and forms an image and second image forming units that are plurally disposed downstream of the first image forming unit in a moving direction of the intermediate transfer member, transfer different color toner images formed on second image carriers to the intermediate transfer member and form images. The base toner image is formed beforehand in a single color region transferred onto the intermediate transfer member from the second image carriers of the second image forming units.

14 Claims, 7 Drawing Sheets

IMAGE FORMING APPARATUS AND IMAGE FORMING METHOD FOR CORRECTING DENSITY NONUNIFORMITY

CROSS-REFERENCE TO RELATED APPLICATION

This application is based on and claims priority under 35 USC 119 from Japanese Patent Application No. 2007-204117 filed Aug. 6, 2007.

BACKGROUND

1. Technical Field

The present invention relates to an image forming apparatus and an image forming method.

2. Related Art

In image forming apparatus employing an intermediate transfer system that primarily transfers toner images from photoconductor drums to an intermediate transfer belt, sometimes density nonuniformity occurs in the rotational axis direction of the photoconductor drums dependently on the pressure distribution of primary transfer rolls and the distribution of developed toner mass. As means that corrects such density nonuniformity, technology that minimizes differences in density having plural gradations in the rotational axis direction of the photoconductor drums has conventionally been disclosed.

SUMMARY

The present invention provides an image forming apparatus that can reduce differences in density uniformity between a single color and a multiple color A first aspect of the present invention is an image forming apparatus comprising: a first image forming unit that includes a rotatable first image carrier on which a base toner image is formed by exposure and development based on input image data, transfers the base toner image formed on the first image carrier to an intermediate transfer member, and forms an image; plural second image forming units that are disposed downstream of the first image forming unit in a moving direction of the intermediate transfer member, the second image forming units each including a rotatable second image carriers on which different color toner images are formed by exposure and development based on input image data, transferring the different respective color toner images formed on the second image carriers to the intermediate transfer member, and forming images; a transport unit that transports a recording medium; a transfer unit that transfers, to the recording medium transported by the transport unit, the base toner image and the color toner images that have been transferred to the intermediate transfer member; and a fixing unit that fixes the base toner image and the color toner images that have been transferred to the recording medium by the transfer unit, the base toner image being formed beforehand in a region where a single color is to be transferred onto the intermediate transfer member from the second image carriers of the second image forming units.

Further, a second aspect of the present invention is an image forming apparatus comprising: a first image forming unit that includes a rotatable first image carrier on which a base toner image is formed by exposure and development based on input image data, transfers the base toner image formed on the first image carrier to an intermediate transfer member, and forms an image, plural second image forming units that are disposed downstream of the first image forming unit in a moving direction of the intermediate transfer member, the second image forming units each including a rotatable second image carrier on which different color toner images are formed by exposure and development based on input image data, the second image forming units each transferring the different respective color toner images formed on the second image carriers to the intermediate transfer member, and forming images, a transport unit that transports a recording medium, a transfer unit that transfers, to the recording medium transported by the transport unit, the base toner image and the color toner images that have been transferred to the intermediate transfer member; and a fixing unit that fixes the base toner image and the color toner images that have been transferred to the recording medium by the transfer unit, the base toner image being formed beforehand at least in a position corresponding to where a single color has been transferred onto the intermediate transfer member from the second image carriers of the second image forming units, and the development amount of the base toner in a position corresponding to a rotational axis direction center portion of the first image carrier being less than that in positions corresponding to end portions of the first image carrier.

Further, a third aspect of the present invention is an image forming apparatus comprising: image forming units that include image carriers on which toner images are formed by exposure and development based on input image data, transfer the toner images formed on the image carriers to an intermediate transfer member, and form images, a transport unit that transports a recording medium, a transfer unit that transfers, to the recording medium transported by the transport unit, the toner images that have been transferred to the intermediate transfer member, a fixing unit that fixes the toner images that have been transferred to the recording medium by the transfer unit, and a base toner image forming unit that forms a base toner image under single color toner images on the intermediate transfer member, so as to cause transfer characteristics of single color toner images to become closer to transfer characteristics of multiple color toner images.

BRIEF DESCRIPTION OF THE DRAWINGS

An exemplary embodiment of the present invention will be described in detail based on the following figures, wherein.

DETAILED DESCRIPTION

Figure 1:
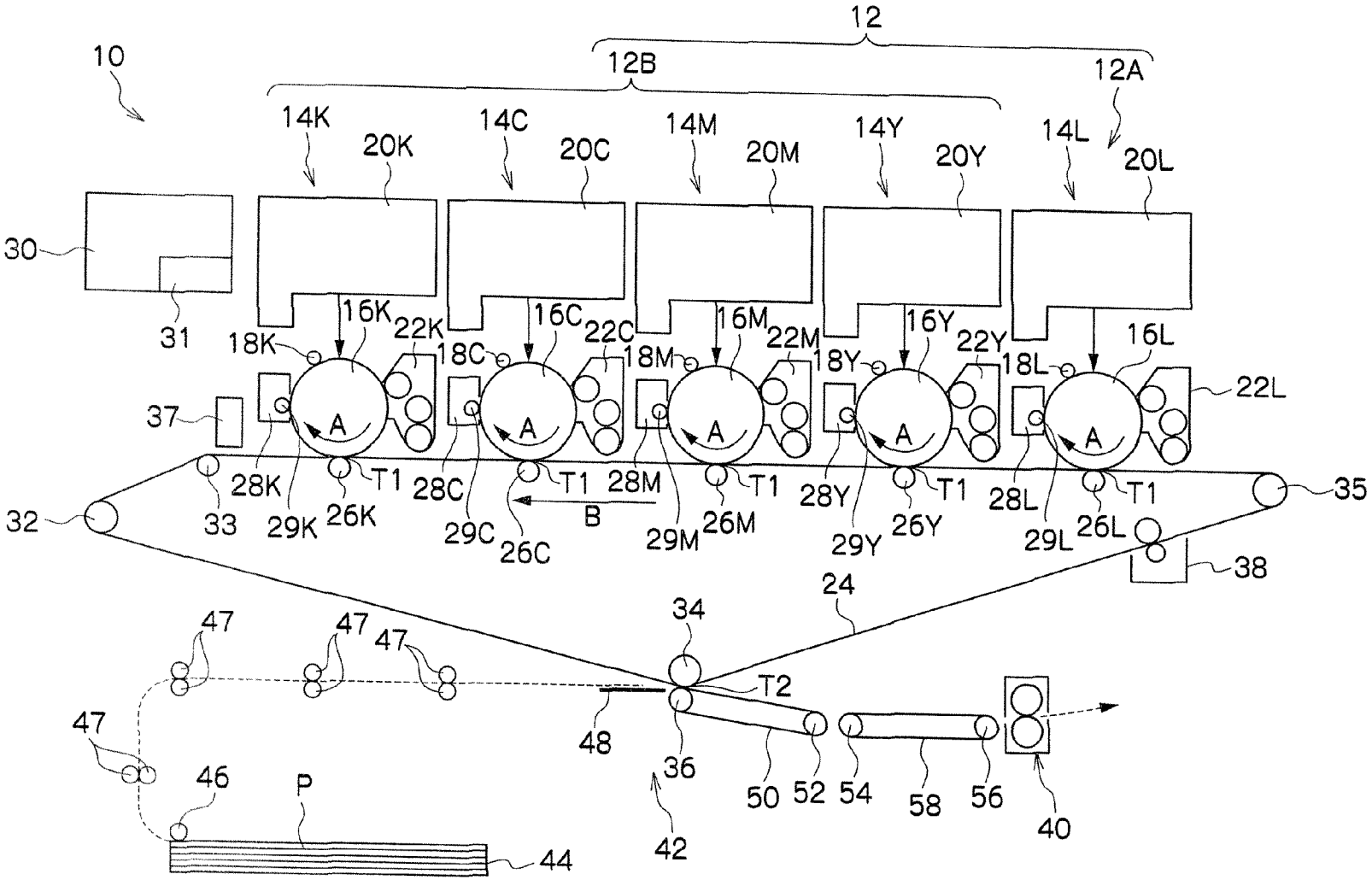
FIG. 1 is a general configural diagram showing an image forming apparatus pertaining to the exemplary embodiment of the invention.

Below, a mode of implementing the present invention will be described in detail on the basis of an exemplary embodiment shown in the drawings. It will be noted that recording paper P will be described as an example of a recording medium. Further, a transparent toner (called "clear toner" below) Lt will be described as an example of a base toner. The clear toner Lt is a toner that becomes transparent after it has been fixed to the recording paper P by a later-described fixing device 40, and it is difficult for the clear toner Lt to affect changes in color with respect to color toners. Further, sites in common between respective colors will be described by adding letters representing respective colors to the ends of reference numerals.

By "base toner" in the present invention is meant a white, transparent, or milky white toner, and by "color toner" is meant a toner comprising a yellow toner, a magenta toner, a cyan toner, and a black toner that are commonly used in image formation. Further, by "single color region" is meant a region in which, in a case where a color toner image has been transferred to the intermediate transfer member from a certain second image carrier of the second image forming units, another color toner image is not formed on that intermediate transfer member. For example, the color toner images can be a yellow toner image, a magenta toner image, a cyan toner image and a black toner image.

FIG. 1 is a schematic configural diagram showing an image forming apparatus 10 regarding to the present exemplary embodiment. First, the configuration of the image forming apparatus 10 will be briefly described. As shown in FIG. 1, the image forming apparatus 10 includes a quintuple tandem system image forming section 12 that transfers, to a later-described endless belt-like intermediate transfer belt 24, toner images of respective colors based on inputted image data to form a full-color image.

The image forming section 12 includes, in order from upstream in a transport direction of the recording paper P, electrophotographic system image forming units 14L, 14Y, 14M, 14C and 14K that output images of the respective colors of clear (L), yellow (Y), magenta (M), cyan (C) and black (K). The clear (L) image forming unit 14L corresponds to a first image forming unit 12A pertaining to the present invention, and the yellow (Y), magenta (M), cyan (C) and black (K) image forming units 14Y to 14K correspond to second image forming units 12B pertaining to the present invention.

Further, the image forming units 14L to 14K are disposed adjacent to each other and a predetermined distance apart from each other along a moving direction (represented by arrow B) of the intermediate transfer belt 24. Additionally, the image forming units 14L to 14K include photoconductor drums 16L to 16K using as image carriers. Each of the photoconductor drums 16L to 16K is configured by a conductive metal cylindrical body on whose surface (peripheral surface) a photoconductive layer comprising an organic photoconductor or the like is laminated, and the photoconductor drums 16L to 16K are driven to rotate at a predetermined process speed in the direction of arrows A (clockwise direction) in FIG. 1.

It will be noted that the photoconductor drum 16L corresponds to a first image carrier pertaining to the present invention, and the photoconductor drums 16Y to 16K correspond to second image carriers pertaining to the present invention. Further, the photoconductive layers are functionally separated photoconductive layers comprising a charge generating layer and a charge transporting layer that are sequentially laminated. The photoconductor drums 16 have the property that, although they ordinarily have a high resistance, when the photoconductor drums 16 are exposed with laser light beams, the specific resistance of the portions that have been exposed with the laser light beams changes. Moreover, it is preferable for the diameter of each of the photoconductor drums 16L to 16K to be in the range of 20 mm to 100 mm.

Disposed around the photoconductor drums 16L to 16K, in order from upstream in the rotational direction thereof, are chargers 18L to 18K using as charging devices that uniformly charge the surfaces (peripheral surfaces) of the photoconductor drums 16L to 16K to a predetermined electric potential, exposure devices 20L to 20K that expose the surfaces (peripheral surfaces) of the uniformly charged photoconductor drums 16 with laser light beams (image light) based on color-separated image data (image signals), developing devices 22L to 22K that transition (develop) charged toners (developers) into electrostatic latent images to form toner images, the endless belt-like intermediate transfer belt 24 that is stretched so as to be capable of revolving on a path contacting the photoconductor drums 16L to 16K, primary transfer rolls 26L to 26K that transfer the toner images formed on the photoconductor drums 16L to 16K to the intermediate transfer belt 24, and cleaning devices 28L to 28K that remove transfer residual toners remaining on the surfaces of the photoconductor drums 16L to 16K after primary transfer.

In the cleaning devices 28L to 28K, there are disposed brush rolls 29L to 29K that pressure-contact the surfaces peripheral surfaces) of the photoconductor drums 16L to 16K, are driven to rotate in the opposite direction of the rotational direction (direction of arrows A) of the photoconductor drums 16L to 16K, and scrape off transfer residual toners from the photoconductor drums 16L to 16K.

Further, the primary transfer rolls 26L to 26K are disposed in positions on the inner side of the intermediate transfer belt 24 that face the photoconductor drums 16L to 16K. Additionally, the portions where the photoconductor drums 16L to 16K and the intermediate transfer belt 24 are brought into contact with each other by the primary transfer rolls 26L to 26K use as primary transfer sections (primary transfer positions) T1.

Further, bias power sources (not shown) that apply primary transfer biases are connected to the primary transfer rolls 26L to 26K. Moreover, the bias power sources are controlled by a controller 30 such that the primary transfer biases that the bias power sources apply to the primary transfer rolls 26L to 26K are capable of being altered. Further, although the chargers 18L to 18K shown in FIG. 1 are configured as roll-shaped contacting chargers, it is also possible to use non-contacting chargers such as scorotrons and solid dischargers.

The intermediate transfer belt 24 using as an intermediate transfer member is wound around the primary transfer rolls 26L to 26K, a drive roll 32 that is driven to rotate by an unillustrated drive source, a tension roll 33 that adjusts the tension in the intermediate transfer belt 24, a backup roll 34 that is disposed in a later-described secondary transfer section (secondary transfer position) T2, and a passively driven roll 35. The intermediate transfer belt 24 rotatingly moves (revolves) in the direction of arrow B synchronously with the rotation of the photoconductor drums 16.

It will be noted that the intermediate transfer belt 24 is formed by dispersing a substance for imparting conductivity, such as carbon or an ion conducting substance, in a resin material such as a polyimide, polyamideimide, a polycarbonate, or a fluorine resin, with its surface resistivity being adjusted to about $10^{10}\Omega/\square$ to $10^{12}\Omega/\square$ (measured voltage: 100 V).

Further, a secondary transfer roll 36 using as a transfer unit that transfers the toner images on the intermediate transfer belt 24 to the recording paper P transported by a later-described transport mechanism 42 using as a transport unit is disposed in a position facing the backup roll 34, with the intermediate transfer belt 24 being interposed between the secondary transfer roll 36 and the backup roll 34. A later-described first transporter belt 50 is wound around the secondary transfer roll 36, and the portion where the secondary transfer roll 36 and the intermediate transfer belt 24 contact each other via the first transporter belt 50 uses as the secondary transfer section (secondary transfer position) T2.

Further, the image forming apparatus 10 is disposed with a toner removing device 38, which removes transfer residual toners remaining on the intermediate transfer belt 24 after the toner images have been transferred onto the recording paper P by the secondary transfer roll 36, and the fixing device 40 using as a fixing unit that fixes the toner images that have been transferred onto the recording paper P by the secondary transfer roll 36.

The transport mechanism 42 is configured by a pickup roll 46 that transports, one sheet at a time, the recording paper P stored in a paper supply unit 44, plural pairs (four pairs are shown in FIG. 1) of transport rolls 47 disposed on a transport path of the recording paper P, a guide member 48 for supplying the recording paper P to the secondary transfer section (secondary transfer position) T2, the first transportor belt 50 that is wound around the secondary transfer roll 36 and a guide roll 52, a second transportor belt 58 that is disposed downstream of the first transporter belt 50 on the transport path of the recording paper P and is wound around guide rolls 54 and 56, and a paper discharge unit (not shown) disposed downstream of the fixing device 40.

The recording paper P stored in the paper supply unit 44 is transported by the transport mechanism 42 to the secondary transfer section (secondary transfer position) T2 where the secondary transfer roll 36 (the first transporter belt 50) and the backup roll 34 face each other with the intermediate transfer belt 24 being interposed between the secondary transfer roll 36 and the backup roll 34, is transported to the fixing device 40 from the secondary transfer section (secondary transfer position) T2, and is transported to the paper discharge unit from the fixing device 40.

The image forming apparatus 10 having the above configuration operates as follows to form a full-color image. It will be noted that because the image forming units 14L to 14K of the respective colors have substantially the same configuration, here, operation where a yellow toner image is formed by the image forming unit 14Y will be described. Further, a clear toner image is already transferred to the intermediate transfer belt 24 by the image forming unit 14L before the yellow toner image is transferred to the intermediate transfer belt 24.

First, the surface of the photoconductor drum 16Y is uniformly charged by the charger 18Y to an electric potential of about −600 V to −800 V. The surface of the uniformly charged photoconductor drum 16Y is exposured with a laser light beam by the exposure device 20Y in accordance with image data for yellow sent from the controller 30. That is, an electrostatic latent image of a yellow printing pattern is formed on the photoconductive layer of the photoconductor drum 16Y.

It will be noted that the electrostatic latent image is an image formed on the surface (photoconductive layer) of the photoconductor drum 16Y by charging, and is a so-called negative latent image that is formed as a result of the specific resistance of the portion of the photoconductive layer that has been exposed with the laser light beam dropping and a charge flowing to the surface of the photoconductor drum 16Y, while the charge of the portion that has not been exposed with the laser light beam remains.

The electrostatic latent image that has been formed on the photoconductor drum 16Y in this manner is transported to a predetermined developing position by the rotation of the photoconductor drum 16Y. Then, the electrostatic latent image on the photoconductor drum 16Y is made into a visible image (a toner image) by the developing device 22Y at this developing position. A yellow toner that includes at least a yellow coloring agent and a bonding resin and whose volumetric average particle size is in the range of 3 μm to 7 μm is stored inside the developing device 22Y.

The yellow toner is frictionally charged as a result of being agitated inside the developing device 22Y and has a charge of the same polarity (−) as the charge of the surface of the photoconductor drum 16Y. Consequently, as the surface of the photoconductor drum 16Y passes the developing device 22Y, the yellow toner electrostatically adheres just to the neutralized latent image portion of the surface of the photoconductor drum 16Y, and the latent image is developed by the yellow toner. Thereafter, the photoconductor drum 16Y continues to rotate, and the toner image that has been developed on the surface thereof is transported to the primary transfer section (primary transfer position) T1.

When the yellow toner image on the surface of the photoconductor drum 16Y is transported to the primary transfer section (primary transfer position) T1, a predetermined primary transfer bias is applied to the primary transfer roll 26Y, and electrostatic force from the photoconductor drum 16 towards the primary transfer roll 26Y acts on the toner image. Then, the toner image on the surface of the photoconductor drum 16Y is transferred to the surface of the intermediate transfer belt 24. The primary transfer bias applied at this time has the opposite polarity (+) of the electric polarity (−) of the toner and, in the image forming unit 14Y, for example, is constant-current-controlled to about +20 μA to +30 μA by the controller 30.

The transfer residual toner on the surface of the photoconductor drum 16Y is cleaned by the cleaning device 28Y. Further, the primary transfer biases applied to the primary transfer rolls 26L, 26M, 20C and 20K of the image forming units 14L, 14M, 14C and 14K are also controlled in the same manner as described above. The intermediate transfer belt 24 to which the yellow toner image has been transferred by the image forming unit 14Y in this manner is sequentially transported to the image forming units 14M, 14C and 14K of the remaining colors, and toner images of the respective colors are transferred such that they are superposed (multiply transferred).

The intermediate transfer belt 24 to which the toner images of all colors have been multiply transferred through the image forming units 14L to 14K is revolved and transported in the direction of arrow B shown in FIG. 1 and reaches the secondary transfer section (secondary transfer position) T2 configured by the backup roll 34 that contacts the inner surface (undersurface) of the intermediate transfer belt 24 and the secondary transfer roll 36 (the first transportor belt 50) disposed on the image holding surface side of the intermediate transfer belt 24.

The recording paper P is supplied between the secondary transfer roll 36 (the first transportor belt 50) and the intermediate transfer belt 24 at a predetermined timing by the transport mechanism 42, and a predetermined secondary transfer bias is applied to the secondary transfer roll 36. The secondary transfer bias applied at this time has the opposite polarity (+) of the polarity (−) of the toners, electrostatic force from the intermediate transfer belt 24 towards the recording paper P acts on the toner images, and the toner images on the surface of the intermediate transfer belt 24 are transferred to the surface of the recording paper P.

Further, the secondary transfer bias at this time is determined by a resistance detected by resistance detecting means (not shown) that detects the resistance of the secondary transfer section (secondary transfer position) T2, and is controlled by a constant voltage. Thereafter, the recording paper P is fed to the fixing device 40, where the toner image is heated and pressured so that the color-superposed (multiply transferred) toner images are melted and permanently fixed to the surface of the recording paper P. The recording paper P to which the full-color image has been fixed in this manner is transported towards the paper discharge unit, and the sequence of full-color image formation operation ends.

It will be noted that a transparent thermoplastic resin that does not include a pigment and has a lower melting point and a lower viscosity than those of the color toners is used as the transparent toner. For example, a homopolymer or a copolymer of a styrene such as styrene, vinyl toluene, α-methyl toluene, cross styrene, and amino styrene or a derivative or a substitution thereof, or a homopolymer or a copolymer of a methacrylic acid ester such as methacrylic acid, methyl methacrylate, and ethyl acrylate, or a homopolymer or a copolymer of an acrylic acid ester such as acrylic acid, methyl acrylate, butyl acrylate, and 2-ethylhexyl acrylate, or a diene such as butadiene and isoprene, or acrylonitrile or a vinyl ether, or a homopolymer of a vinyl monomer such as maleic acid anhydride, vinyl chloride, and vinyl acetate, or a copolymer with another monomer, or polyamide, polyester, or polyurethane can be used by singly or mixed together. In the present exemplary embodiment, a polyester transparent toner is used as the transparent toner in consideration of compatibility with the color toners when it is heated and melted and optical characteristics after it thermally fuses with the color toners. Further, the average particle size and melt viscosity characteristics of the transparent toner are the same as those of the color toners.

Next, a method of reducing differences in density uniformity between a single color and a color-superposed multiple color in the image forming apparatus 10 will be described. It will be noted that because the same correction is performed in regard to each color, here, a magenta image that is a single color and a red image (image where a yellow image and a magenta image are color-superposed) that is a multiple color will be described as an example.

Further, the size of the sheets of recording paper P used in density detection is A3, and the image used in density detection is a halftone image with a gradation Cin (input coverage) of 60%. Additionally, a density profile is obtained from the average color distribution in the rotational axis direction of the photoconductor drums 16Y to 16K (the second image carriers) in which this halftone image is detected across a process direction by a scanner.

Figure 2A:
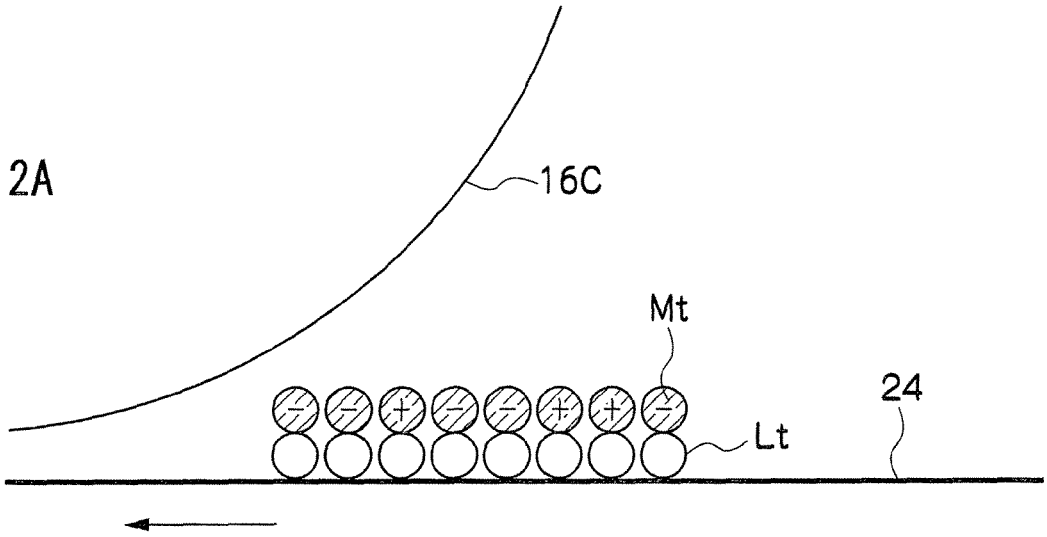
FIG. 2A and FIG. 2B are explanatory diagrams schematically showing retransfer during primary transfer.
Figure 2B:
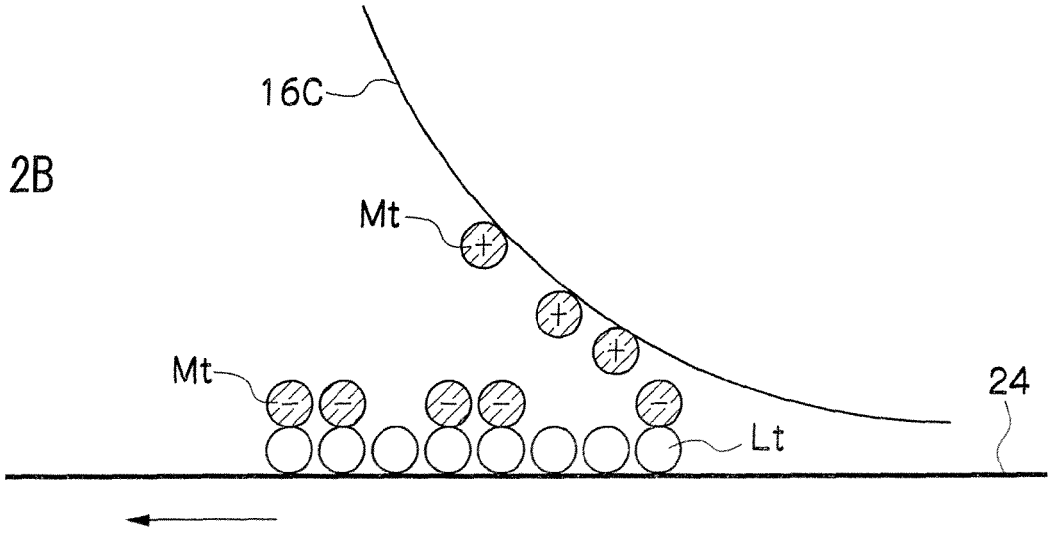

For example, as shown in FIG. 2A, sometimes a phenomenon (called "retransfer" below) occurs where some, although it is a slight amount, of magenta toner Mt that has been primarily transferred onto the intermediate transfer belt 24 from the upstream photoconductor drum 16M switches to the opposite polarity and ends up being transferred to the downstream photoconductor drums 16. In FIG. 2B, there is shown a state where some of the magenta toner Mt ends up being retransferred to the photoconductor drum 16C.

Figure 6:
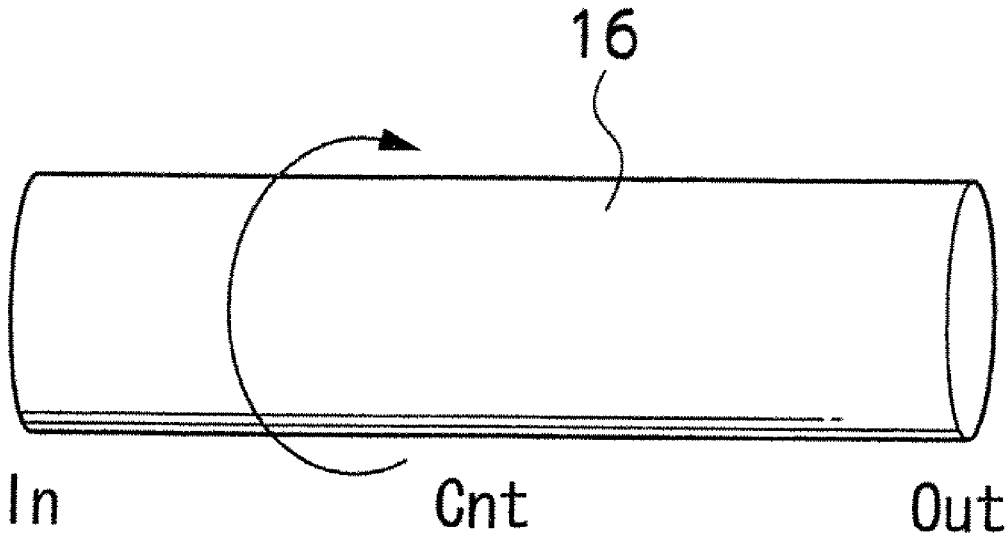
FIG. 6 is a general perspective diagram for describing sites of a photoconductor drum.

Further, sometimes retransfer differs depending on the position in the rotational axis direction of the photoconductor drums 16Y to 16K (the second image carriers). Consequently, positions in the rotational axis direction of the photoconductor drums 16 are defined as shown in FIG. 6. That is, the left end of the photoconductor drum 16 shown in FIG. 6 is defined as "In", the center portion is defined as "Cnt", and the right end portion is defined as "Out". The "In" and "Out" referred to in the present exemplary embodiment mean regions up to 40 mm towards the center portion from the left end portion and the right end portion of image data formed on the surface of the photoconductor drum 16.

Further, a conventionally known method is utilized for density correction based on detection results. That is, the density correction (analysis method, algorithm, etc.) used here is the density correction described in JP-A No. 2004-138609, and the present exemplary embodiment also includes the contents described in this publication.

The density correction described in this publication detects (calculates) the densities (here, the density of the magenta toner Mt) of a single color and a multiple color in the rotational axis direction of the photoconductor drums 16 with a detection unit 37 (see FIG. 1) and, on the basis of the results of that detection (calculation), corrects the exposure amount (electric potential balance) in the rotational axis direction of the photoconductor drums 16 with a correction unit 31 included in the controller 30.

In other words, the density correction derives, from the results of detection by the detection unit 37, a density profile of a single color in the rotational axis direction of the photoconductor drums 16 and a density profile of a single color component within a multiple color. Thereafter, the density correction calculates, from a relationship expression between a predetermined light amount correction amount (%) and density, a corrected light amount (%) for the density profile of the single color component within the multiple color to become closer to flat, and corrects the exposure amount by that corrected light amount (%) and exposes the photoconductor drums 16.

First, as a comparative example, a case will be described where a difference in density uniformity between a single color and a color-superposed multiple color on the recording paper P corresponding to the rotational axis direction of the photoconductor drums 16 is corrected by just this conventional density correction.

Figure 5A:
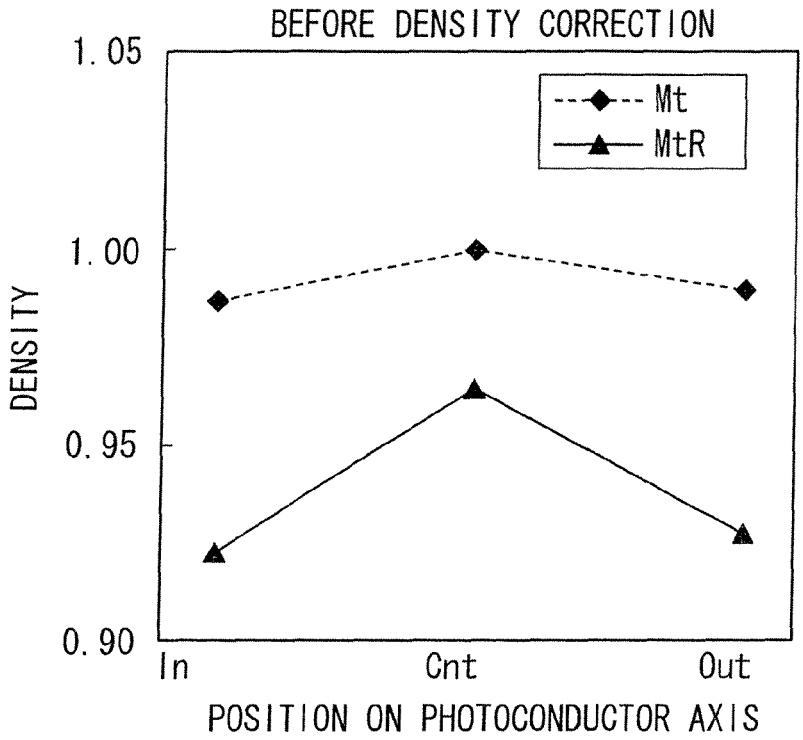
FIG. 5A and FIG. 5B are graphs showing conventional density correction results.
Figure 5B:
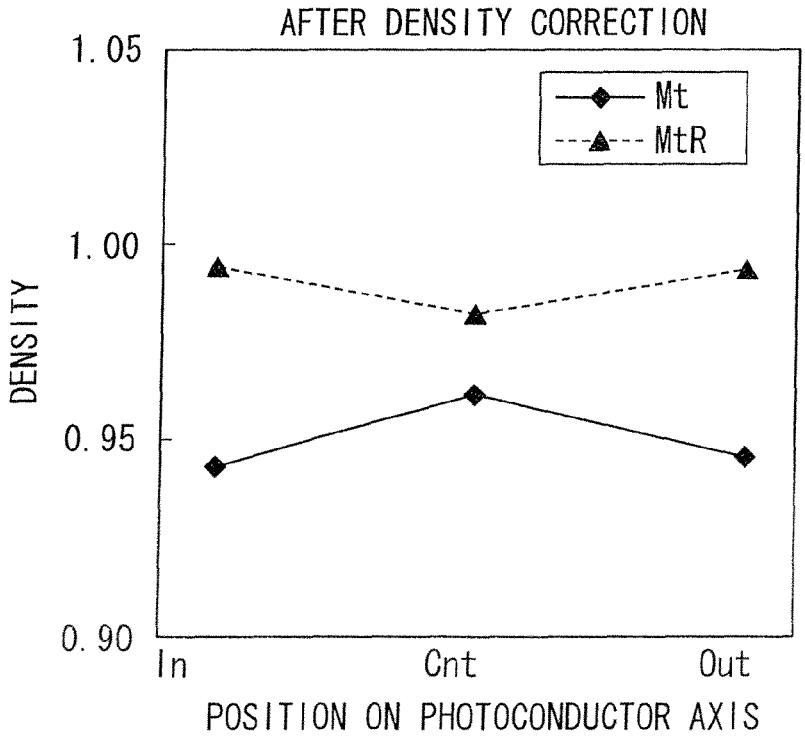

In FIG. 5A, there are shown results of detection (density profiles) of the density of the magenta toner Mt within a single color magenta image and the density of magenta toner MtR within a red image that is a multiple color before density correction. Additionally, in FIG. 5B, there are shown results of detection (density profiles) of the density of the magenta toner Mt within a single color magenta image and the density of magenta toner MtR within a red image that is a multiple color after density correction.

As will be understood from FIG. 5A, even with the same magenta toner, the density profiles in the rotational axis direction of the photoconductor drum 16 differ greatly between the magenta toner Mt used in a single color and the magenta toner MtR used in red that is a multiple color. In other words, the primary transfer efficiency of the magenta toner Mt when forming a single color magenta image and the primary transfer efficiency of the magenta toner MtR when forming a red image that is a multiple color differ greatly.

The reason for that is because the adhesive force working on the single color magenta toner Mt on the intermediate transfer belt 24 is larger than the adhesive force working on the multiple color magenta toner MtR that is superposed on the yellow toner Yt and, after primary transfer, a greater amount of the magenta toner MtR of the multiple color image that switches to the opposite polarity when it passes through the primary transfer sections T1 of cyan (C) and black (K) retransfers to the cyan (C) and black (K) photoconductor drums 16C and 16K than that of the magenta toner Mt of the single color image.

This is also because there is a correlation between the pressure of the primary transfer rolls 26 and the amount of toner that is retransferred. That is, because the primary transfer rolls 26 are pressed against the photoconductor drums 16 by the application of pressure from both end portions, the force of pressure-contact is higher in the vicinities of the end portions than in the vicinities of the center portions in the rotational axis direction thereof. Consequently, for both the single color magenta toner Mt and the magenta toner MtR within the red image that is a multiple color, the amount of toner that is retransferred is greater in the vicinities of the end portions than in the vicinities of the center portions, and with respect to the densities at these end portions, that of the magenta toner MtR within the red image that is a multiple color is lower than that of the single color magenta toner Mt.

In other words, the density of the magenta toner MtR used in the multiple color is lower than the density of the magenta toner Mt used in the single color and in the single color magenta toner Mt and the magenta toner MtR within the red image that is a multiple color, the difference in the amount of toner that is retransferred becomes greater in the vicinities of the end portions than in the vicinities of the center portions. For that reason, in this state, even if correction density is implemented in accordance with the contents described in the aforementioned publication, the difference in density uniformity between a single color and a color-superposed multiple color on the recording paper P corresponding to the rotational axis direction of the photoconductor drums 16 cannot be reduced equal to or less than a necessary value (see FIG. 5B).

Thus, next, a method of correcting density nonuniformity in the rotational axis direction of the photoconductor drums 16 of the present exemplary embodiment utilizing the preceding density correction will be described. In the image forming apparatus 10 pertaining to the present exemplary embodiment, a transfer condition of the clear toner Lt using as a base toner is determined on the basis of image data of a single color that have been inputted. That is, here, before the magenta toner Mt used in a single color is transferred to the intermediate transfer belt 24, the clear toner Lt is transferred under a predetermined transfer condition to a site using as a foundation of the magenta toner Mt on the intermediate transfer belt 24 (see FIG. 2A and FIG. 2B).

Thus, although it looks like a single color, in the primary transfer sections T1, the adhesive force working in the case of a multiple color works in the same manner also on the magenta toner Mt in the case of this single color. In other words, because the magenta toner Mt is superposed on the clear toner Lt in order to form a single color magenta image, the adhesive force between the magenta toner Mt and the intermediate transfer belt 24 becomes substituted to the adhesive force between the magenta toner Mt and the clear toner Lt. Therefore, the primary transfer efficiency of the single color magenta toner Mt drops and is aligned equally with the density profile of the magenta toner MtR within the red image that is a multiple color.

Figure 3A:
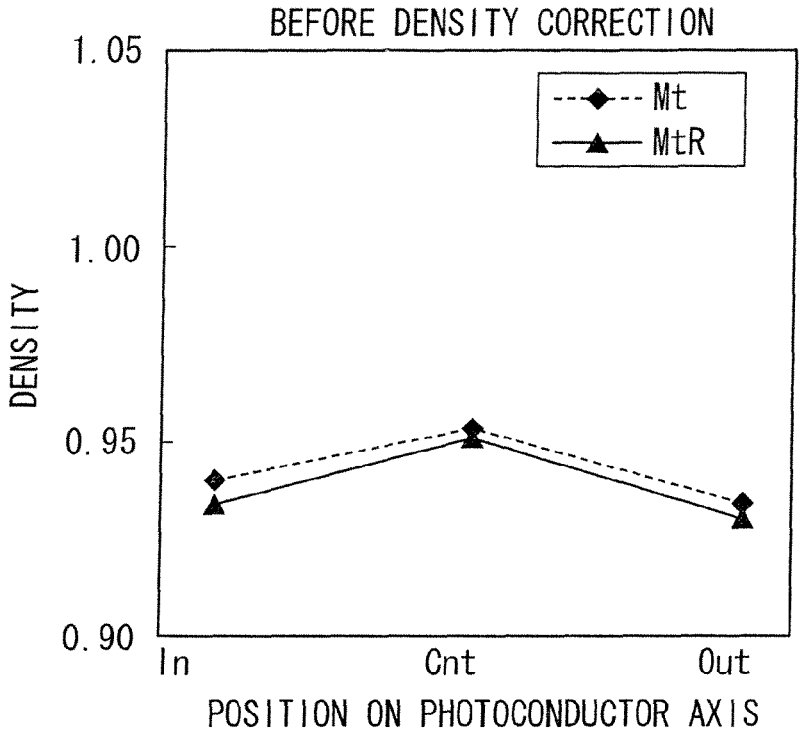
FIG. 3A and FIG. 3B are graphs showing density correction results pertaining to the exemplary embodiment of the invention.
Figure 3B:
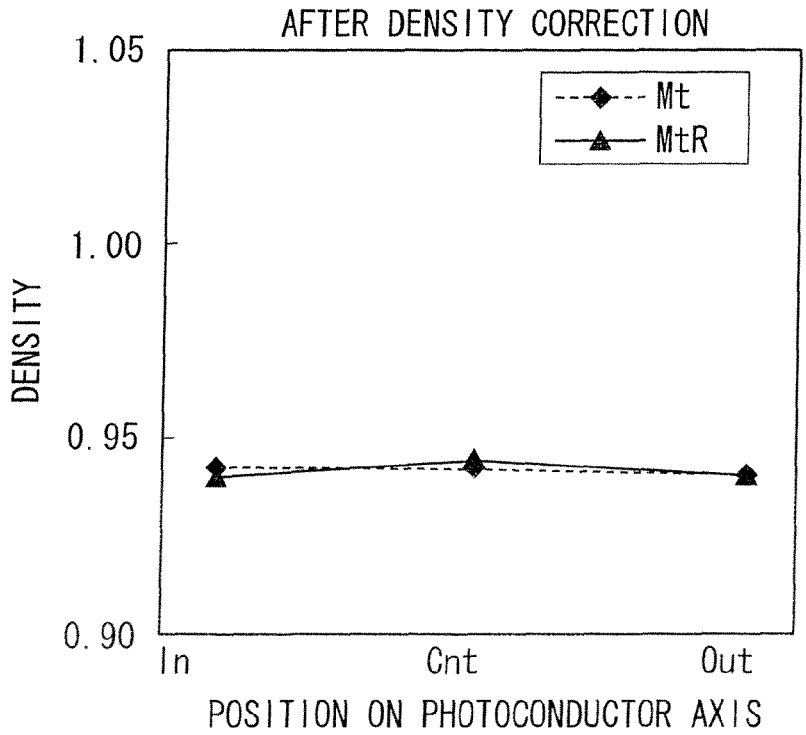

FIG. 3A and FIG. 3B show density detection results (density profiles) in this case. As will be understood from FIG. 3A, in the densities before density correction, the density profiles in the rotational axis direction of the photoconductor drums 16 of the single color (magenta toner Mt) and the single color component (magenta toner MtR) within the multiple color are aligned. Consequently, when density correction is thereafter performed in order to improve the density uniformity of the single color magenta toner Mt in the rotational axis direction of the photoconductor drums 16 (when the exposure amount with respect to the photoconductor drums 16 is corrected), then as shown in FIG. 3B, the density of the multiple color is also corrected simultaneously such that the density profile of the multiple color also becomes closer to flat.

Figure 7:
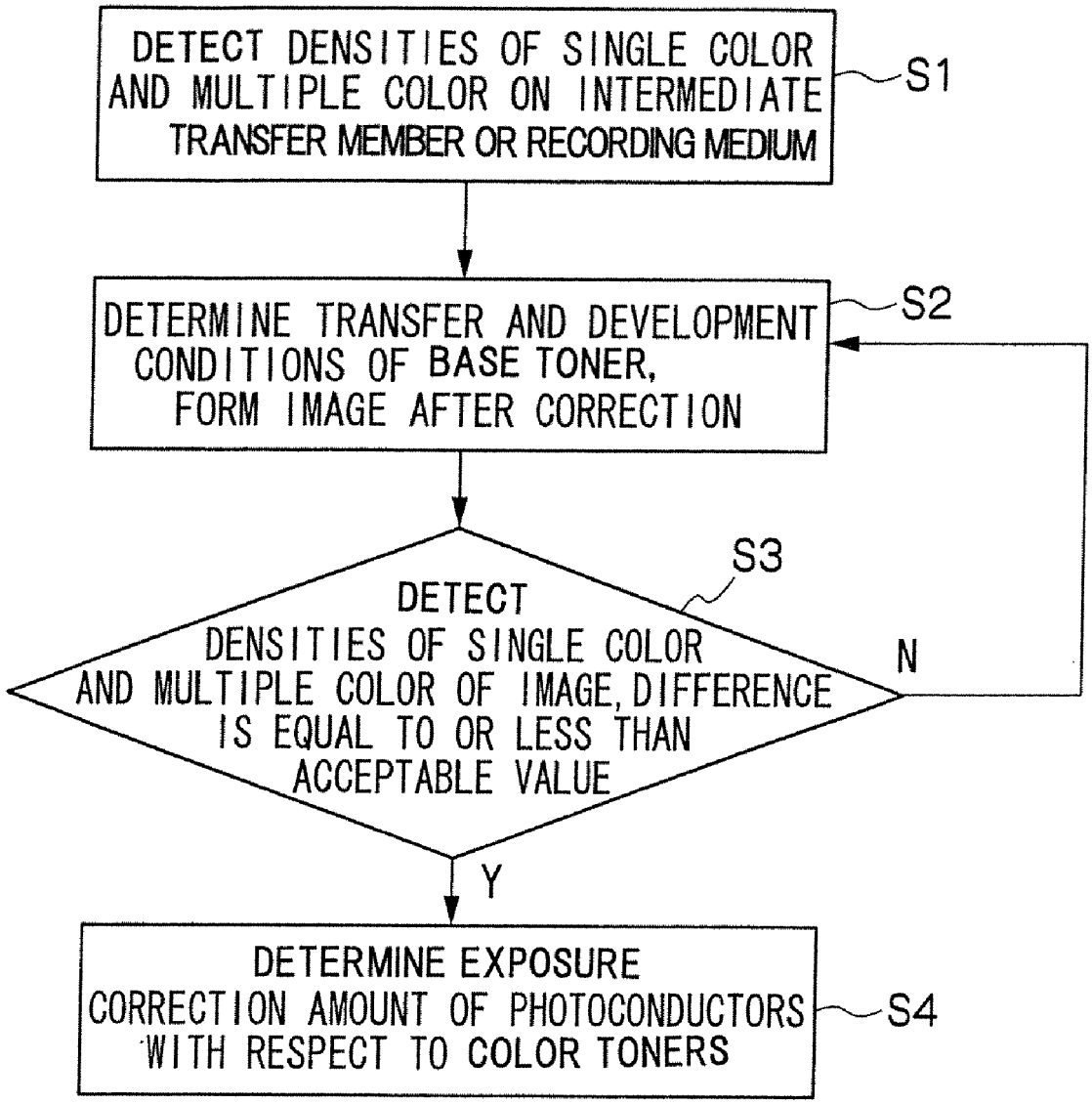
FIG. 7 is a flowchart of density correction pertaining to the exemplary embodiment of the invention.

FIG. 7 shows a flowchart of a method of correcting density nonuniformity in the rotational axis direction of the photoconductor drums 16. That is, first, in step S1, the densities of a single color and a multiple color on the intermediate transfer belt (intermediate transfer member) 24 or on the recording paper (recording medium) P are detected. Next, in step S2, the transfer and development condition of the base toner is determined, and an image after correction is formed. Next, in step S3, the densities of the single color and the multiple color of the image are detected, and it is judged whether or not the difference is equal to or less than an acceptable value. When that difference is greater than the acceptable value, then the flow returns again to step S2, and step S3 is again repeated. When that difference is equal to or less than the acceptable value, then in step S4, a exposure correction amount of the photoconductor drums 16 with respect to the color toners is determined.

Further, in the present exemplary embodiment, the supply amount of the clear toner Lt was 4.2 g/m$^2$ per unit area on the intermediate transfer belt 24, but during normal printing, when the supply amount of the clear toner Lt is small, the probability that there will be no clear toner Lt under the magenta toner Mt becomes higher, so the effect thereof becomes smaller. Consequently, the supply amount of the clear toner Lt is controlled by the controller 30 on the basis of the results of detection (results of calculation) by the detection unit 37. It will be noted that, when the above-described control is not used, it has been confirmed that the same effect can be obtained by setting, with respect to the toner amount of the magenta toner Mt per unit area of the intermediate transfer belt 24, so as to cover 20% or more of the clear toner Lt.

Further, in the preceding exemplary embodiment, the supply amount of the clear toner Lt was 4.2 g/m$^2$ regardless of the position in the rotational axis direction of the photoconductor drums 16, but the supply amount of the clear toner Lt may also be controlled by the controller 30 so as to become amounts that differ for each position in the rotational axis direction of the photoconductor drums 16 in order to reduce the consumption amount of the clear toner Lt. That is, as shown in FIG. 4A and FIG. 4B, for example, the clear toner Lt may be adjusted just at the "In" sides and the "Out" sides where the force of pressure-contact resulting from the primary transfer rolls 26 is high.

Figure 4A:
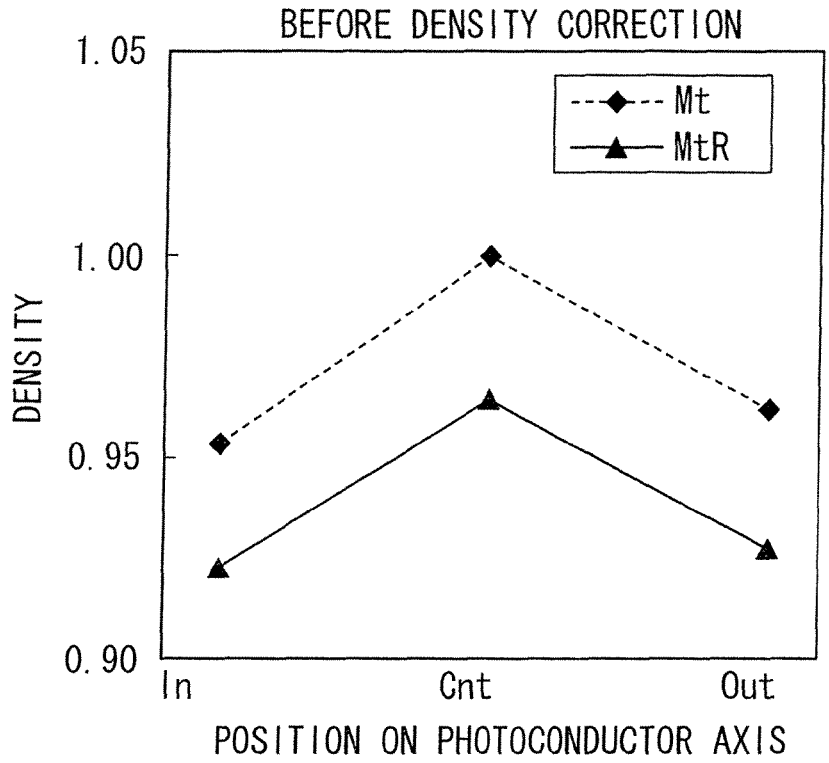
FIG. 4A and FIG. 4B are graphs showing density correction results pertaining to the exemplary embodiment of the invention.

In this manner, by adjusting the clear toner Lt just for a single color at places ("In" sides and "Out" sides) where the force of pressure-contact resulting from the primary transfer rolls 26 is high, the shape thereof can be adjusted to become substantially the same as that of the density profile of a multiple color (see FIG. 4A). Further, even when the density profiles of a single color and a multiple color do not overlap, as long as the shapes thereof are substantially the same, the density profiles of the single color and the multiple color are respectively corrected by the algorithm of density correction described in the aforementioned publication (by correction of the exposure amount with respect to the photoconductor drums 16) (see FIG. 4B).

Figure 4B:
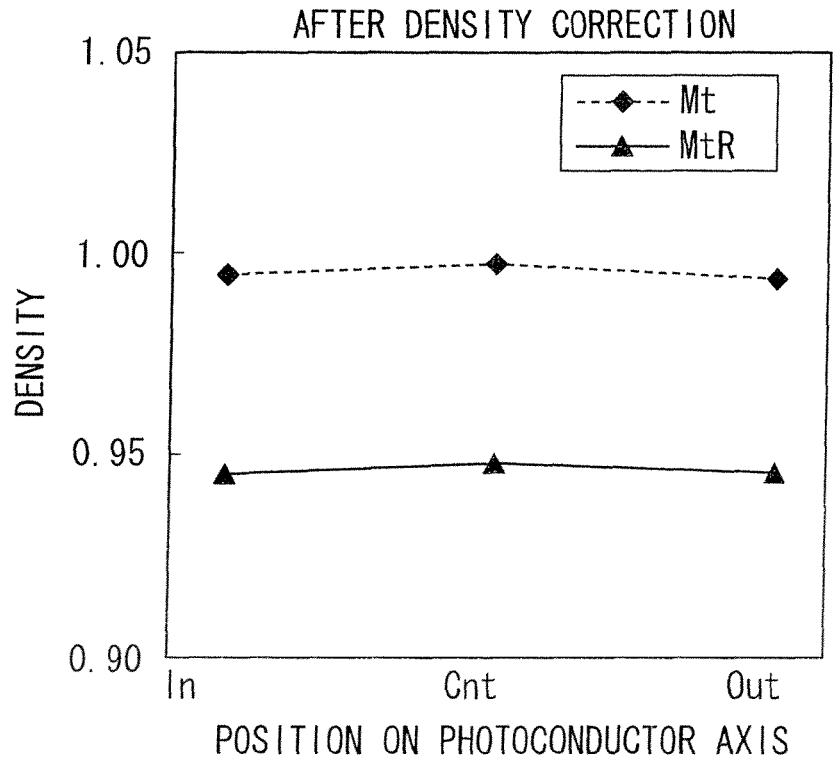

As described above, in relation to correcting differences in density nonuniformity between a single color and a multiple color, there is an effect in either of the cases shown in FIG. 3A and FIG. 3B and in FIG. 4A and FIG. 4B. In other words, in either case, density nonuniformity in the rotational axis direction of the photoconductor drums 16 is corrected regardless of whether it is a single color or a multiple color. It will be noted that although the same effect was obtained as a result of performing the same experiment using white toner for the base toner, white spots remained in the image after fixing because the white toner is transferred to the bottommost layer of the intermediate transfer belt 24, that is, to the uppermost layer of the recording paper P. Consequently, it is desirable for the base toner to be a toner having the property that it becomes transparent after being fixed.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first image forming unit that includes a rotatable first image carrier on which a base toner image is formed by exposure and development based on input image data, transfers the base toner image formed on the first image carrier to an intermediate transfer member, and forms an image;

a plurality of second image forming units that are disposed downstream of the first image forming unit in a moving direction of the intermediate transfer member, the second image forming units each including a rotatable second image carrier on which different color toner images are formed by exposure and development based on input image data, the second image forming units each transferring the different respective color toner images formed on the second image carriers to the intermediate transfer member, and forming images;

a transport unit that transports a recording medium;

a transfer unit that transfers, to the recording medium transported by the transport unit, the base toner image and the color toner images that have been transferred to the intermediate transfer member;

a fixing unit that fixes the base toner image and the color toner images that have been transferred to the recording medium by the transfer unit, the base toner image being formed beforehand in a region where a single color is to be transferred onto the intermediate transfer member from the second image carriers of the second image forming units, and a correction unit that, on the basis of the density of the color toner images that have been transferred to the intermediate transfer member:

corrects a development amount of the base toner by correcting a exposure amount with respect to the first image carrier, or corrects a development amount of the color toners by correcting a exposure amount with respect to the second image carriers; or corrects the development amount of the base toner by correcting the exposure amount with respect to the first image carrier, and also corrects the development amount of the color toners by correcting the exposure amount with respect to the second image carriers.

2. The image forming apparatus of claim 1, further comprising a detection unit that detects the density of the color toner images that have been transferred to the intermediate transfer member.

3. An image forming apparatus comprising:

a first image forming unit that includes a rotatable first image carrier on which a base toner image is formed by exposure and development based on input image data, transfers the base toner image formed on the first image carrier to an intermediate transfer member, and forms an image;

a plurality of second image forming units that are disposed downstream of the first image forming unit in a moving direction of the intermediate transfer member, the second image forming units each including a rotatable second image carrier on which different color toner images are formed by exposure and development based on input image data, the second image forming units each transferring the different respective color toner images formed on the second image carriers to the intermediate transfer member, and forming images;

a transport unit that transports a recording medium;

a transfer unit that transfers, to the recording medium transported by the transport unit, the base toner image and the color toner images that have been transferred to the intermediate transfer member;

a fixing unit that fixes the base toner image and the color toner images that have been transferred to the recording medium by the transfer unit, the base toner image being formed beforehand in a region where a single color is to be transferred onto the intermediate transfer member from the second image carriers of the second image forming units, and a correction unit that, on the basis of the density of the color toner images that have been transferred and fixed to the recording medium:

corrects a development amount of the base toner by correcting a exposure amount with respect to the first image carrier, or corrects a development amount of the color toners by correcting a exposure amount with respect to the second image carriers; or corrects the development amount of the base toner by correcting the exposure amount with respect to the first image carrier, and also corrects the development amount of the color toners by correcting the exposure amount with respect to the second image carriers.

4. The image forming apparatus of claim 3, further comprising a detection unit that detects the density of the color toner images that have been transferred and fixed to the recording medium.

5. The image forming apparatus of claim 1, wherein the base toner is a transparent toner that becomes transparent after being fixed by the fixing unit.

6. An image forming apparatus comprising:

a first image forming unit that includes a rotatable first image carrier on which a base toner image is formed by exposure and development based on input image data, transfers the base toner image formed on the first image carrier to an intermediate transfer member, and forms an image;

a plurality of second image forming units that are disposed downstream of the first image forming unit in a moving direction of the intermediate transfer member, the second image forming units each including a rotatable second image carrier on which different color toner images are formed by exposure and development based on input image data, the second image forming units each transferring the different respective color toner images formed on the second image carriers to the intermediate transfer member, and forming images;

a transport unit that transports a recording medium;

a transfer unit that transfers, to the recording medium transported by the transport unit, the base toner image and the color toner images that have been transferred to the intermediate transfer member;

a fixing unit that fixes the base toner image and the color toner images that have been transferred to the recording medium by the transfer unit, the base toner image being formed beforehand at least in a position corresponding to where a single color has been transferred onto the intermediate transfer member from the second image carriers of the second image forming units, and the development amount of the base toner in a position corresponding to a rotational axis direction center portion of the first image carrier being less than that in positions corresponding to end portions of the first image carrier, and a correction unit that, on the basis of the density of the color toner images that have been transferred to the intermediate transfer member:

corrects a development amount of the base toner by correcting a exposure amount with respect to the first image carrier, or corrects a development amount of the color toners by correcting a exposure amount with respect to the second image carriers; or corrects the development amount of the base toner by correcting the exposure amount with respect to the first image carrier, and also corrects the development amount of the color toners by correcting the exposure amount with respect to the second image carriers.

7. An image forming apparatus comprising:

a first image forming unit that includes a rotatable first image carrier on which a base toner image is formed by exposure and development based on input image data, transfers the base toner image formed on the first image carrier to an intermediate transfer member, and forms an image;

a plurality of second image forming units that are disposed downstream of the first image forming unit in a moving direction of the intermediate transfer member, the second image forming units each including a rotatable second image carrier on which different color toner images are formed by exposure and development based on input image data, the second image forming units each transferring the different respective color toner images formed on the second image carriers to the intermediate transfer member, and forming images;

a transport unit that transports a recording medium;

a transfer unit that transfers, to the recording medium transported by the transport unit, the base toner image and the color toner images that have been transferred to the intermediate transfer member;

a fixing unit that fixes the base toner image and the color toner images that have been transferred to the recording medium by the transfer unit, the base toner image being formed beforehand at least in a position corresponding to where a single color has been transferred onto the intermediate transfer member from the second image carriers of the second image forming units, and the development amount of the base toner in a position corresponding to a rotational axis direction center portion of the first image carrier being less than that in positions corresponding to end portions of the first image carrier, and a correction unit that, on the basis of the density of the color toner images that have been transferred and fixed to the recording medium:

corrects a development amount of the base toner by correcting a exposure amount with respect to the first image carrier, or corrects a development amount of the color toners by correcting a exposure amount with respect to the second image carriers; or corrects the development amount of the base toner by correcting the exposure amount with respect to the first image carrier, and also corrects the development amount of the color toners by correcting the exposure amount with respect to the second image carriers.

8. The image forming apparatus of claim 6, wherein the base toner is a transparent toner that becomes transparent after being fixed by the fixing unit.

9. An image forming apparatus comprising:

a plurality of image forming units that include image carriers on which toner images are formed by exposure and development based on input image data, transfer the toner images formed on the image carriers to an intermediate transfer member, and form images;

a transport unit that transports a recording medium;

a transfer unit that transfers, to the recording medium transported by the transport unit, the toner images that have been transferred to the intermediate transfer member;

a fixing unit that fixes the toner images that have been transferred to the recording medium by the transfer unit;

a base toner image forming unit that forms a base toner image under single color toner images on the intermediate transfer member, so as to cause transfer characteristics of single color toner images to become closer to transfer characteristics of multiple color toner images, and a correction unit that, on the basis of the density of the color toner images that have been transferred and fixed to the recording medium:

corrects a development amount of the base toner by correcting a exposure amount or corrects a development amount of the color toners by correcting a exposure amount with respect to the image carriers; or corrects the development amount of the base toner by correcting the exposure amount and also corrects the development amount of the color toners by correcting the exposure amount with respect to the image carriers.

10. The image forming apparatus of claim 9, wherein the base toner is a transparent toner that becomes transparent after being fixed by the fixing unit.

11. An image forming method comprising:

forming a base toner image on a rotatable first image carrier by exposure and development based on input image data, and transferring the base toner image formed on the first image carrier to an intermediate transfer member;

in a moving direction of the intermediate transfer member to which the base toner image has been transferred, respectively forming a plurality of different color toner images on respective rotatable second image carriers by exposure and development based on input image data, and transferring the respective different color toner images formed on the second image carriers to the intermediate transfer member;

transferring, to a recording medium, the base toner image and the color toner images that have been transferred to the intermediate transfer member;

fixing the base toner image and the color toner images that have been transferred to the recording medium, the base toner image being formed in advance in a region where a single color is to be transferred onto the intermediate transfer member from the second image carriers, and on the basis of the density of the color toner images that have been transferred to the intermediate transfer member, one of:

correcting a development amount of a base toner by correcting an exposure amount with respect to the first image carrier;

correcting a development amount of color toners by correcting an exposure amount with respect to the second image carriers; and correcting the development amount of the base toner by correcting the exposure amount with respect to the first image carrier, and also correcting the development amount of the color toners by correcting the exposure amount with respect to the second image carriers.

12. The image forming method of claim 11, further comprising detecting the density of the color toner images that have been transferred to the intermediate transfer member.

13. An image forming method comprising:

forming a base toner image on a rotatable first image carrier by exposure and development based on input image data, and transferring the base toner image formed on the first image carrier to an intermediate transfer member;

in a moving direction of the intermediate transfer member to which the base toner image has been transferred, respectively forming a plurality of different color toner images on respective rotatable second image carriers by exposure and development based on input image data, and transferring the respective different color toner images formed on the second image carriers to the intermediate transfer member;

transferring, to a recording medium, the base toner image and the color toner images that have been transferred to the intermediate transfer member;

fixing the base toner image and the color toner images that have been transferred to the recording medium, the base toner image being formed in advance in a region where a single color is to be transferred onto the intermediate transfer member from the second image carriers, and on the basis of the density of the color toner images that have been transferred and fixed to the recording medium, one of:

correcting a development amount of a base toner by correcting an exposure amount with respect to the first image carrier;

correcting a development amount of color toners by correcting an exposure amount with respect to the second image carriers; and correcting the development amount of the base toner by correcting the exposure amount with respect to the first image carrier, and also correcting the development amount of the color toners by correcting the exposure amount with respect to the second image carriers.

14. The image forming method of claim 13, further comprising detecting the density of the color toner images that have been transferred and fixed to the recording medium.

* * * * *